US010358758B2

(12) United States Patent
Lv et al.

(10) Patent No.: US 10,358,758 B2
(45) Date of Patent: Jul. 23, 2019

(54) INNER TUB OF WATER-SAVING WASHING MACHINE

(71) Applicant: QINGDAO HAIER WASHING MACHINE CO., LTD., Shandong (CN)

(72) Inventors: Peishi Lv, Shandong (CN); Lin Yang, Shandong (CN); Yun Tian, Shandong (CN); Gangjin Zhang, Shandong (CN); Feng Li, Shandong (CN); Chunxia Zhou, Shandong (CN)

(73) Assignee: QINGDAO HAIER WASHING MACHINE CO., LTD., Shandong, Qingdao (CN)

( * ) Notice: Subject to any disclaimer, the term of this patent is extended or adjusted under 35 U.S.C. 154(b) by 7 days.

(21) Appl. No.: 15/556,903

(22) PCT Filed: Jul. 3, 2015

(86) PCT No.: PCT/CN2015/083303
§ 371 (c)(1),
(2) Date: Sep. 8, 2017

(87) PCT Pub. No.: WO2016/141646
PCT Pub. Date: Sep. 15, 2016

(65) Prior Publication Data

US 2018/0237972 A1 Aug. 23, 2018

(30) Foreign Application Priority Data

Mar. 10, 2015 (CN) ..... 2015 1 0104026

(51) Int. Cl.
*D06F 37/12* (2006.01)
*D06F 37/02* (2006.01)
(Continued)

(52) U.S. Cl.
CPC ..... *D06F 37/12* (2013.01); *D06F 37/02* (2013.01); *D06F 37/24* (2013.01); *D06F 37/245* (2013.01); *D06F 39/083* (2013.01)

(58) Field of Classification Search
CPC ..... D06F 37/02; D06F 37/12; D06F 37/24; D06F 37/245
See application file for complete search history.

(56) References Cited

U.S. PATENT DOCUMENTS 3,603,118 A * 9/1971 Brucken ..... D06F 23/04 68/174
5,570,596 A * 11/1996 Imai ..... D06F 35/006 68/12.02
(Continued)

FOREIGN PATENT DOCUMENTS

CN 2397150 Y 9/2000
CN 2397151 Y 9/2000
(Continued)

OTHER PUBLICATIONS

Machine translation of JP-52036869-A to Kobayashi. (Year: 1977).*
(Continued)

*Primary Examiner* — Joseph L. Perrin
(74) *Attorney, Agent, or Firm* — Buchanan Ingersoll & Rooney PC

(57) ABSTRACT

An inner tub of a water-saving washing machine comprises a balance ring, a tub body and a tub bottom. An annular block groove which opens downward is arranged inside an upper end of the tub body, the annular block groove is provided with a plurality of drain holes for draining water outside of the inner tub. The balance ring is mounted on the upper end of the tub body and cooperates with the tub body to form the annular block groove. Or, the annular block groove is integrally formed inwardly from an edge of the tub body. Or, an annular bending piece is mounted on the upper
(Continued)

end of the tub body, the annular bending piece and the tub body cooperate or the annular bending piece itself constitute the annular block groove.

11 Claims, 7 Drawing Sheets

(51) Int. Cl.
*D06F 37/24* (2006.01)
*D06F 39/08* (2006.01)

(56) References Cited

U.S. PATENT DOCUMENTS 5,586,455 A * 12/1996 Imai ..... D06F 37/40 68/12.02
2010/0326141 A1* 12/2010 Chung ..... D06F 23/04 68/23.2
2011/0247373 A1* 10/2011 Sharp ..... D06F 23/04 68/131
2016/0160421 A1* 6/2016 Alexander ..... D06F 37/245 74/572.4

FOREIGN PATENT DOCUMENTS

CN 201165612 Y 12/2008
CN 202000139 U 10/2011
CN 102560961 A 7/2012
JP 52036869 A * 3/1977
JP 09-220395 A 8/1997
JP 2008-229154 A 10/2008

OTHER PUBLICATIONS

International Search Report (PCT/ISA/210) dated Dec. 16, 2015, by the Japanese Patent Office as the International Searching Authority for International Application No. PCT/CN2015/083303.
Written Opinion (PCT/ISA/237) dated Dec. 16, 2015, by the Japanese Patent Office as the International Searching Authority for International Application No. PCT/CN2015/083303.

* cited by examiner

PRIOR ART

INNER TUB OF WATER-SAVING WASHING MACHINE

TECHNICAL FIELD

The present disclosure relates to a field of washing machine, specifically to an inner tub of a washing machine, in particularly to an inner tub of a washing machine which is capable of containing water during washing.

BACKGROUND

The existing pulsator washing machine, as shown in FIG. 1, generally comprises a pulsator 1', an inner tub 2', an outer tub 3' and a casing 4' arranged in order from inside to outside, wherein the pulsator 1' is arranged at a center of a bottom and is rotatable driven by a driving means 5'. A balance ring 6' is provided on a top of the inner tub 2'; a plurality of rows of dewatering holes 21' are longtitudinally arranged in the side wall of the inner tub 2'; and a drain hole 22' is arranged at the bottom of the inner tub 2', the drain hole 22' is also provided as a hole which a output shaft 51' of the driving means 5' penetrating through.

When the washing machine starts to operate, the drain valve 8' is closed and water is supplied into the inner tub 2'. When the water is filled up the inner tub 2', the water flows into the outer tub 3' through the drain hole 21' in the side wall of the inner tub 2' and fills up the whole outer tub 3', which is, the space between the bottom of the outer tub 3' and the bottom of the inner tub 2', the space between the side wall of the outer tub 3' and the side wall of the inner tub 2' are filled up with water. When the water reaches a set water level, the water supply is completed and the washing machine starts to wash. Specifically, the driving means 5' drives the pulsator 1' to rotate forward and backward, the water and clothes in the inner tub 2' roll over and clothes rub against each other driven by the rotation of the pulsator 1'. Meanwhile, the rolling clothes are rubbed against the pulsator and the side wall of the inner tub repeatedly to clean the clothes, by which the washing purpose is achieved. After the washing, the washing machine needs to discharge the water in the tubs and further dewaters the clothes. Specifically, during the drainage, the drain valve 8' is open and the water between the outer tub 3' and the inner tub 2' is discharged outside the casing 4' through the drainage outlet 7' at the bottom of the outer tub 3', the drain valve 8', and a drain pipeline 9' in turn. Meanwhile, the water in the inner tub 2' is discharged through the dewatering hole 21' into the outer tub to keep the water level the same until the water in the inner tub 2' flows down though the drain hole 22' at the bottom of the inner tub 2' into the outer tub 3' and then discharged away through the drainage outlet 7' at the bottom of the outer tub 3'. During the dewatering, the driving means 5' drives the inner tub 2' to rotate at a high speed, under the action of centrifugal force, the water contained by the clothes is discharged into the outer tub 3' through the dewatering hole 21' in the side wall and the drain hole 22' at the bottom of the inner tub 2', and then discharged outside the washing machine through the drainage hole 7' and the drain pipeline.

In the existing pulsator washing machine, the space between the side walls of inner tub and outer tub is filled up with water during the washing. But the water between the inner and outer tubs is not used for washing, the water truly used for washing is the water in the inner tub, which wastes a lot water resources. In addition, too much water between the inner and outer tubs will reduce the concentration of detergent or powder detergent in the washing solution.

Many manufacturers made improvements to the above defects, and introduced a water-saving washing machine, which there is no leaking holes in the tub wall of the inner tub for discharging water. The non-porous inner tub is used as a washing tub for containing washing water and as a centrifugal dewatering tub (i.e. inner tub without holes) when the water used for washing and rinsing is all contained in the inner tub without holes. The outer tub of the non-porous water-saving washing machine is actually a container which is used to pool the water dewatered from the non-porous inner tub during the dewatering process. During the drainage, the inner tub rotates at a high speed, the water inside the tub moves upward along the wall of the inner tub under the action of centrifugal force and discharged through the drain hole below the balance ring and on the upper part of the inner tub. Or the drainage outlet which is controllable of opening and closing is provided at the lower part of the inner tub and most of the water is discharged through the drainage outlet. During the centrifugal dewatering, the non-porous inner tub rotates at a high speed, the water left in the clothes moves upward along the wall of the non-porous inner tub under the action of the centrifugal force and discharged into the outer tub through the drain hole. The water is further discharged away through the drainage outlet and the drain pipeline at the bottom of the outer tub. As a result of saving the water in "sandwich" or the water between the inner and outer tubs of the traditional washing machine, the average water saving effect of up to 50%.

However, the drain holes at the upper part of the inner tub of the water-saving washing machine mentioned above are arranged in the wall of the inner tub, and the number of the drain holes are usually small. Otherwise, the structural strength is deteriorated. Due to a small number of the drain holes, the total area of the drain holes is relatively small and the water displacement is limited. During the drainage and the dewatering processes, the centrifugal force coming from the high speed rotation drives most of the water to exceed the height of position provided with the drain holes and part of the water will remain in the inner tub eventually. So a lot of water is remained in the clothes and the dewatering effect is not good. Some of the manufacturers made some improvements, for example, the Chinese patents with application No. 200820003576.3 and the application No. 201020691475.7 disclose a structure of an inner tub and a drain hole of a washing machine.

The structure mentioned above, the use of a balance ring with the inner tub forms a new drainage structure, so that the water moving upward is directly discharged. However, during the dewatering, an eccentricity problem is existed. And the drain holes in the opposite direction of the eccentric position drains faster and the drain holes at the eccentric position drains slower. Until the last part of drains holes finish draining, the opposite position retained more water, which will cost more time to finish dewatering. In addition, the eccentricity degree relatively increases at the part where the eccentricity happened, resulting in slower increasing rotation speed during the dewatering and even the tubs hitting the casing to produce noise. Thus, it needs more time to redistribute the laundry and further increases the dewatering time.

In the view of foregoing, the present disclosure is proposed.

SUMMARY OF INVENTION

A technical problem needs to be solved in the present disclosure is to overcome the shortcomings of the prior art and to provide an inner tub of a water-saving washing machine which has a simple structure and is able to drain fast.

In order to solve the technical problem mentioned above, the basic scheme adopted by the present disclosure is as following. An inner tub of a water-saving washing machine comprises a balance ring, a tub body and a tub bottom. The inner tub is a water containing tub during washing, an annular block groove which opens downward is arranged inside an upper end of the tub body, water circulates in the annular block groove in a circumferential direction, the annular block groove is provided with a plurality of drain holes for draining water outside of the inner tub.

Further, the balance ring is mounted on the upper end of the tub body and cooperates with the tub body to form the annular block groove.

Further, the upper end of the tub body comprises a circle of connecting portion for connecting the balance ring and a circle of forming portion for cooperating with the balance ring and forming a part of a side wall of the annular block groove. An outer side wall of the annular block groove coincides with the forming portion.

Further, the forming portion on the upper end of the tub body bends inwardly and extends upwardly to form the connecting portion, the connecting portion is fixedly connected to the balance ring. There is a radial distance between the forming portion and an outer side wall of the balance ring, the forming portion and the balance ring cooperate with each other to form the annular block groove. The forming portion constitutes an outer side wall and a top wall of the annular block groove, and part of the outer side wall of the balance ring constitutes an inner side wall of the annular block groove.

Or, a lower part of the balance ring bends inwardly and a radial distance is formed between the lower part of the balance ring and the forming portion of the upper end of the tub body, the balance ring and the forming portion cooperate with each other to form the annular block groove. The connecting portion on the upper end of the tub body is fixedly connected to the upper part of the balance ring, the lower part of the balance ring which bends inwardly forms the inner side wall of the annular block groove. The convex of the upper part of the balance ring relative to the lower part of the balance ring constitutes the top wall of the annular block groove, and the forming portion constitutes the outer side wall of the annular block groove.

Further, the outer side wall of the balance ring is provided outwardly with a circle of convex ribs, the connecting portion on the upper end of the tub body is provided with a flanging. The flanging wraps the convex rib and is in pressing connection with the convex rib.

Further, the balance ring comprises a main body and a circle of blocking rib which protrudes to a lower surface of the main body. There is a radial distance between the blocking rib and the forming portion on the upper end of the tub body, and the blocking rib and the forming portion of the tub body cooperate to form the annular block groove. The outer side wall of the main body is provided outwardly with a circle of convex rib, the connecting portion on the upper end of the tub body flanges and wraps the convex rib and is in pressing connection with the balance ring.

Further, the lower part of the balance ring is inclined inwardly from top to bottom, so that the lower part of the balance ring is easily inserted into an opening of the upper end of the tub body, which is convenient to install. In particular, a circle of a blocking rib structure which is inclined inwardly from top to bottom is adopted. Even if the upper end of the tub body is slightly deformed, the balance ring is able to insert into the opening of the upper end of the tub body by using a deformation of the blocking rib structure, which is easy for the balance ring to mount on the tub body.

Further, the outer side wall of the balance ring is in tightly contact with the connecting portion on the upper end of the tub body, which are in a sealed connection. So there is no leakage between the outer side wall of the balance ring and the connecting portion when the inner tub rotates at a high speed.

Or, an alternative scheme for the scheme mentioned above is that the annular block groove is integrally formed by bended inwardly from an edge of the tub body.

Or, an annular bending piece is mounted on the upper end of the tub body, the annular bending piece and the tub body cooperate to constitute the annular block groove, or the annular bending piece itself constitutes the annular block groove.

In one embodiment, for the outer side wall of the balance ring, the radial distance between the blocking rib provided at the lower part of the main body of the balance ring and the forming portion of the tub body is 5 mm to 20 mm.

Further, the drain holes are distributed in the outer side wall of the annular block groove. Preferably, the drain holes are distributed in the outer side wall and near the top wall of the annular block groove, and/or the drain hole are distributed in the top wall of the annular block groove. Preferably, the drain hole is distributed in the top wall and near the outer side wall of the annular block groove.

The drain holes provided in the top wall of the annular block groove drain upwardly and the drained water falls down to the bottom of the outer tub through the space between the inner and outer tubs after the water is blocked by a cover of the outer tub. The drain holes provided on the outer side wall of the annular block groove drains in a horizontal direction, the drained falls down to the bottom of the outer tub through the gap between the inner and outer tubs after the water is blocked by the inner wall of the outer tub.

Further, the relationship between a diameter of the drain hole and the spacing of the adjacent drain holes is satisfied the ratio from 1:1 to 1:10. The diameter of the drain hole is 3-8 mm, the spacing of the adjacent drain holes is 5-50 mm.

The present disclosure has the follow beneficial effect compares to the prior art by adopting the scheme mentioned above.

When the washing machine with the inner tub of the present disclosure controls the inner tub to rotate at a set speed, the water in the inner tub moves upwardly along the tub wall under the action of centrifugal force while rotating in the circumferential direction. The water spirally rises into the annular block groove and is discharged through the drain holes. In the process of rotation of the inner tub, the water is affected by the amount of eccentricity, and moves in the opposite direction of the eccentricity in the annular block groove, cooperating with the balance ring to offset the eccentricity. In addition, affected by the eccentricity, the position in the opposite of the eccentricity has a faster draining speed. When the water in the position is discharged, the water at the eccentricity direction moves to the position in the opposite direction of the eccentricity in the annular block groove to assist to balance the eccentricity of the balance ring.

DETAILED DESCRIPTION OF THE EMBODIMENTS

Embodiments of the present disclosure are further described in detail with the reference to the accompanying drawings.

Figure 1:
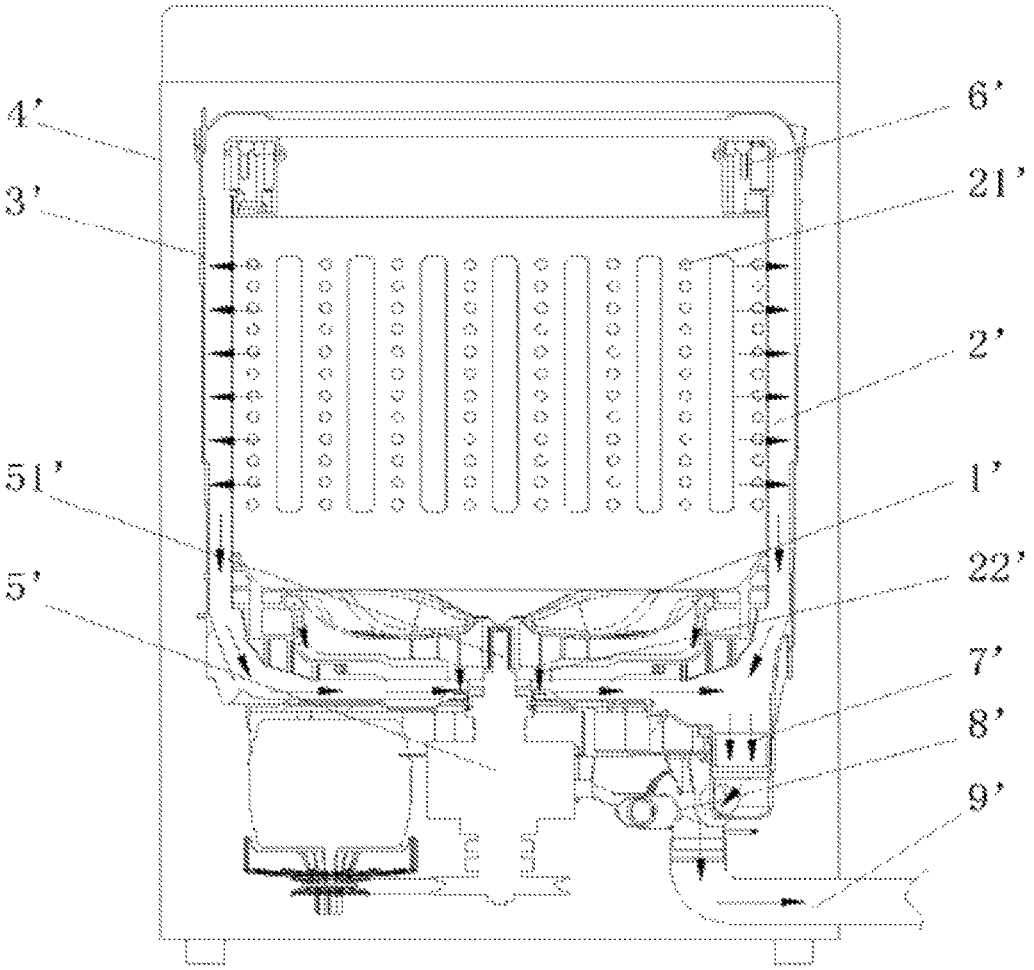
FIG. 1 is a schematic view of a prior art washing machine.
Figure 2:
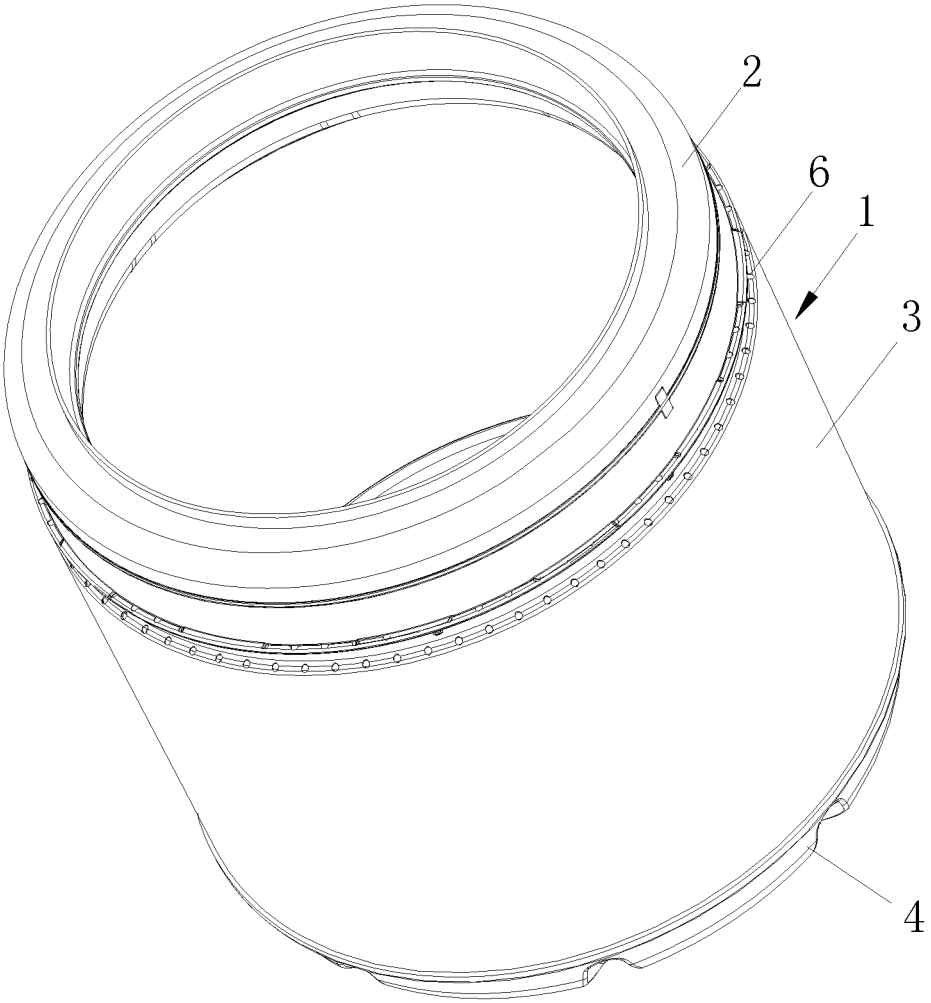
FIG. 2 is a schematic view of an inner tub of the washing machine of the present disclosure.
Figure 3:
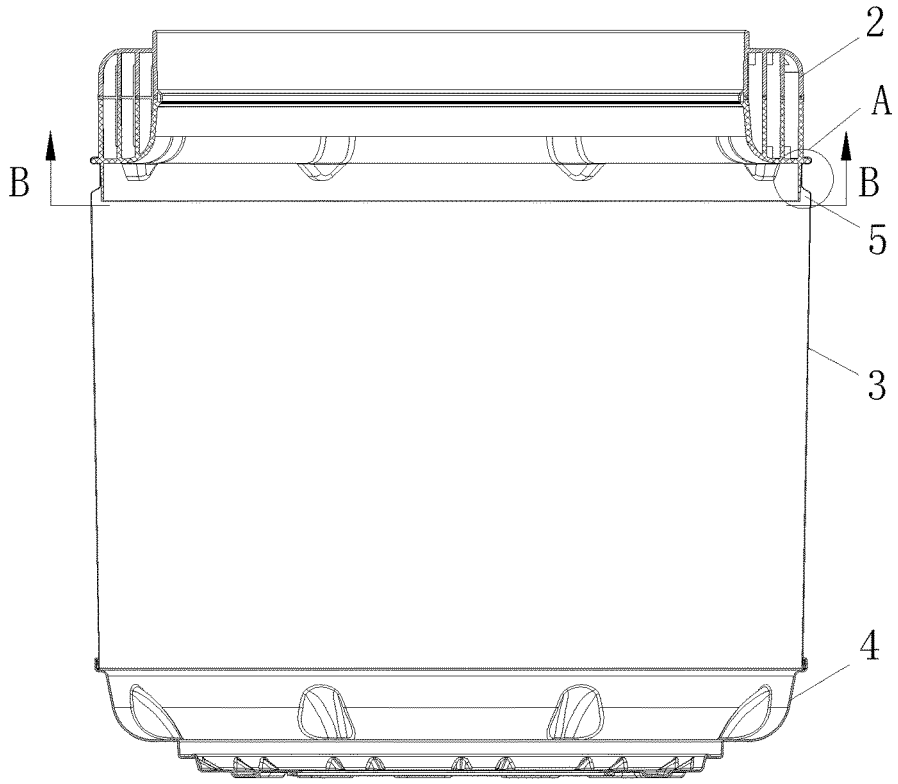
FIG. 3 and FIG. 8 are schematic views of the structures of the annular block grooves formed by the combination of different tub bodies of inner tubs and balance rings of the present disclosure.
Figure 5:
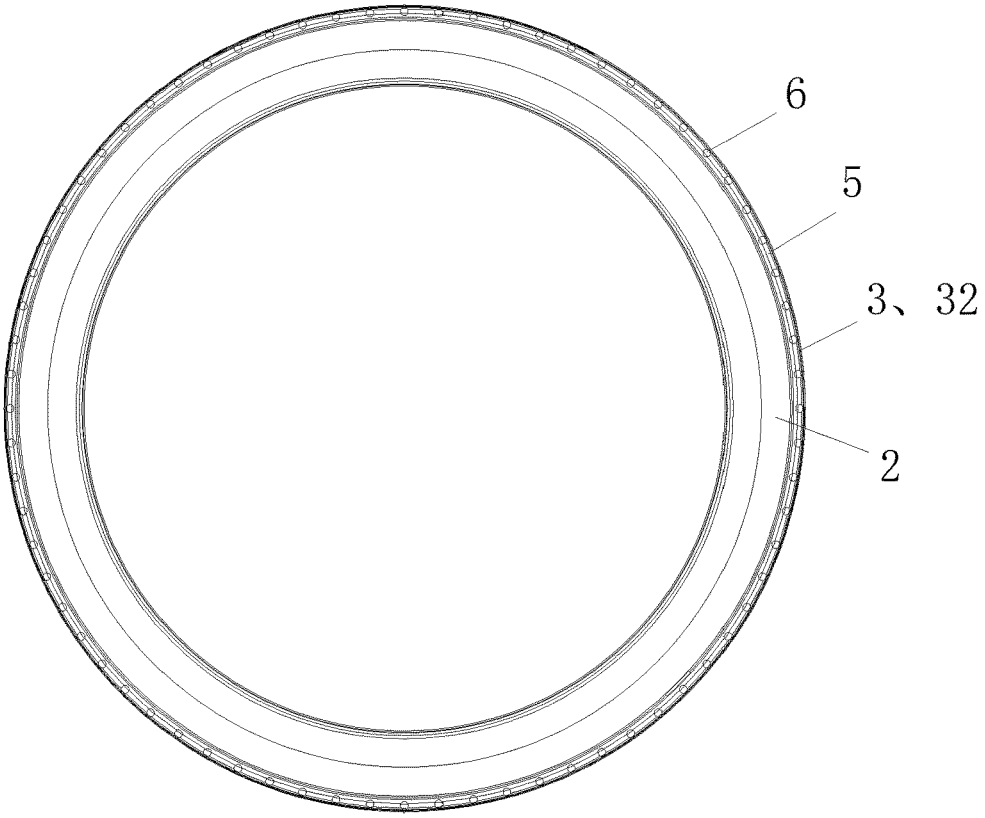
FIG. 5 is schematic diagram of the B-B direction in FIG. 3.

As shown in FIG. 2 and FIG. 3, the inner tub 1 of said water-saving washing machine of the present disclosure comprises a balance ring 2, tub body 3 and a tub bottom 4. The inner tub 1 is a water containing tub, there is no water between the inner and outer tubs during the washing process to save washing water and relatively save washing detergent. An annular block groove 5 which opens downward is arranged inside an upper end of the tub body 3, water circulates in the annular block groove 5 in a circumferential direction, that is, there is no partition in the annular block groove 5 (see FIG. 5). The annular block groove 5 is provided with a plurality of drain holes 6 for draining water out of the inner tub.

During the centrifugal dewatering, the inner tub rotates at a high speed, the water retained in the clothes spirally rises along the tub wall of the inner tub under the action of centrifugal force into the annular block groove 5, and is discharged into the outer tub through drain holes 6 and further discharged away though the drainage outlet and the drain pipeline at the bottom of the outer tub. In the process of rotation of the inner tub, the water is affected by the amount of eccentricity, and moves in the opposite direction of the eccentricity in the annular block groove 5, cooperating with the balance ring to offset the eccentricity. In addition, affected by the eccentricity, the position in the opposite of the eccentricity has a faster draining speed. When the water in the position is discharged, the water at the eccentricity direction moves to the position in the opposite direction of the eccentricity in the annular block groove to assist the balance ring to balance the eccentricity. The principle of water flow in the annular block groove is the same as that of the balance liquid in the balance ring.

Embodiment 1

As shown in FIG. 3, FIG. 4, FIG. 8 and FIG. 9, the balance ring 2 of the present embodiment is mounted on the upper end of the tub body 3 and cooperates with the tub body 3 to form the annular block groove 5. The upper end of the tub body 3 comprises a circle of connecting portion 31 for connecting the balance ring 2 and a circle of forming portion 32 for cooperating with the balance ring 2 and forming a part of a side wall of the annular block groove 5. An outer side wall of the annular block groove 5 coincides with the forming portion 32. The annular block groove is located at the outer circle of the balance ring 2 (see FIG. 3 and FIG. 4), or the annular block groove 5 is located below the balance ring 2 (see FIG. 8 and FIG. 9).

Embodiment 2

Figure 4:
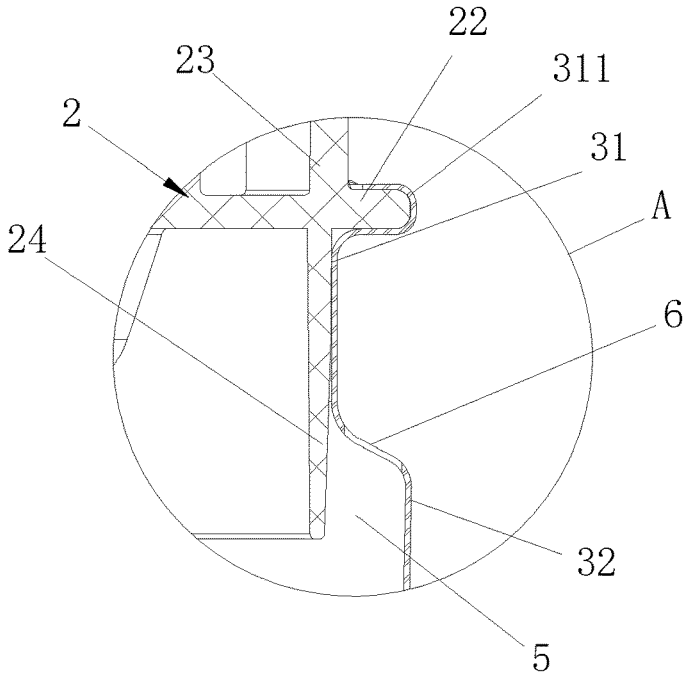
FIG. 4 is an enlarged view at A of FIG. 3.
Figure 6:
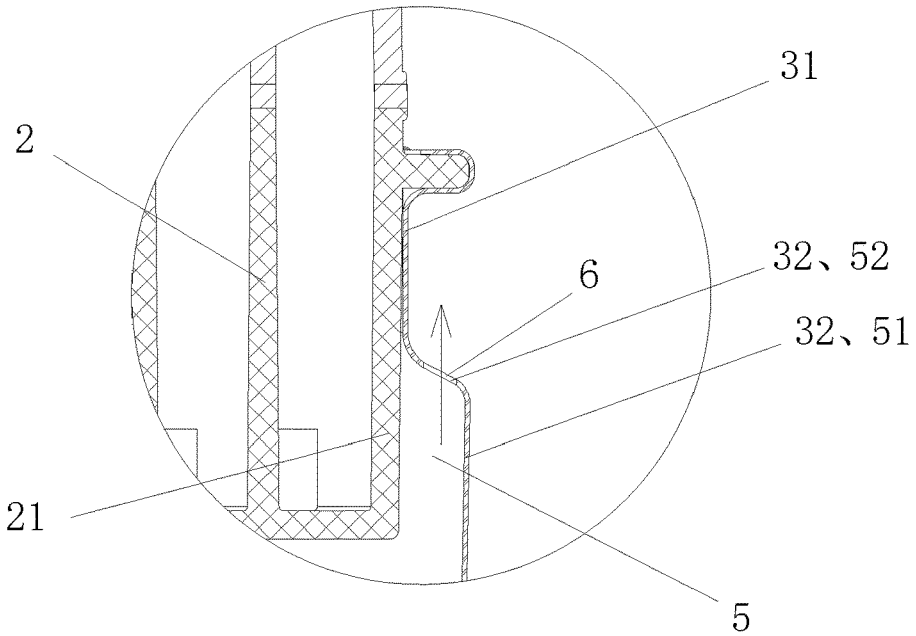
FIG. 6 and FIG. 10 are partial magnification schematic view of the annular block groove formed by the combination of another tub body and the balance ring.
Figure 7:
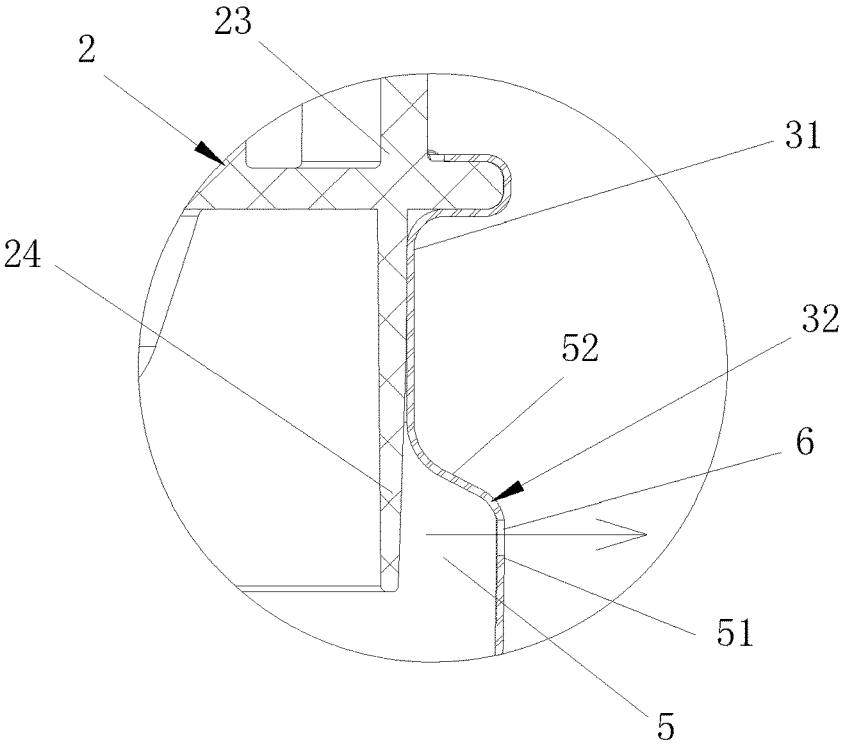
FIG. 7 is a schematic view of a drainage structure of another drain hole of the present disclosure.

As shown in FIG. 4, FIG. 6 and FIG. 7, in the present embodiment, the forming portion 32 on the upper end of the tub body 3 bends inwardly and extends upwardly to form the connecting portion 31, the connecting portion 31 is fixedly connected to the balance ring 2. There is a radial distance between the forming portion 32 and an outer side wall of the balance ring 2 (see FIG. 6), the forming portion and the balance ring cooperate with each other to form the annular block groove 5. The forming portion 32 constitutes an outer side wall 51 and a top wall 52 of the annular block groove 5 (see FIG. 7), and part of the outer side wall 21 of the balance ring constitutes an inner side wall of the annular block groove 5 (see FIG. 6).

Embodiment 3

Figure 8:
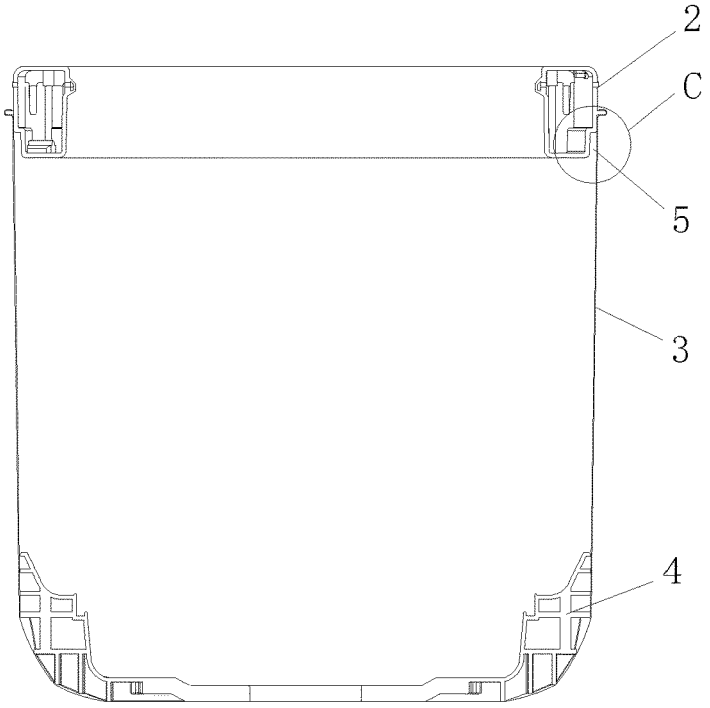
Figure 9:
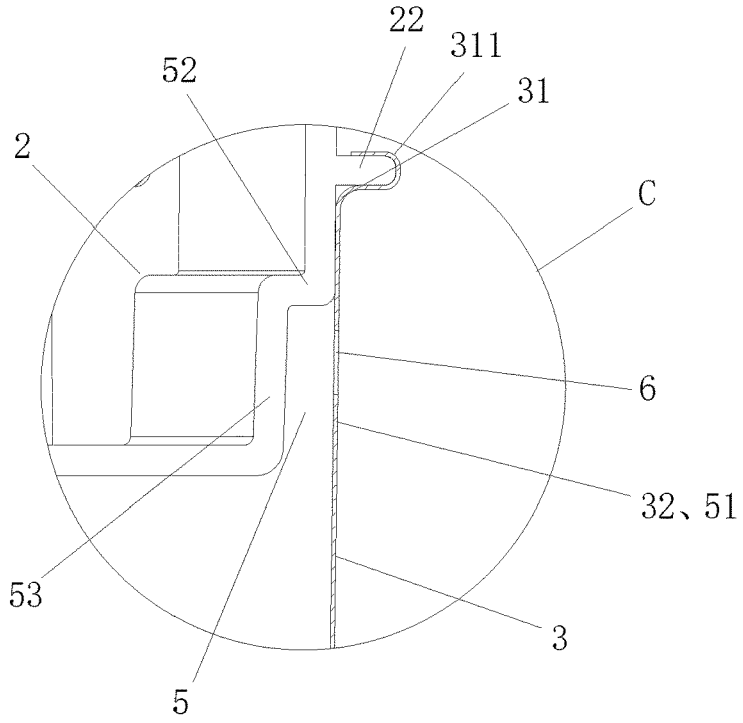
FIG. 9 is an enlarged schematic view of the portion C in FIG. 8.
Figure 10:
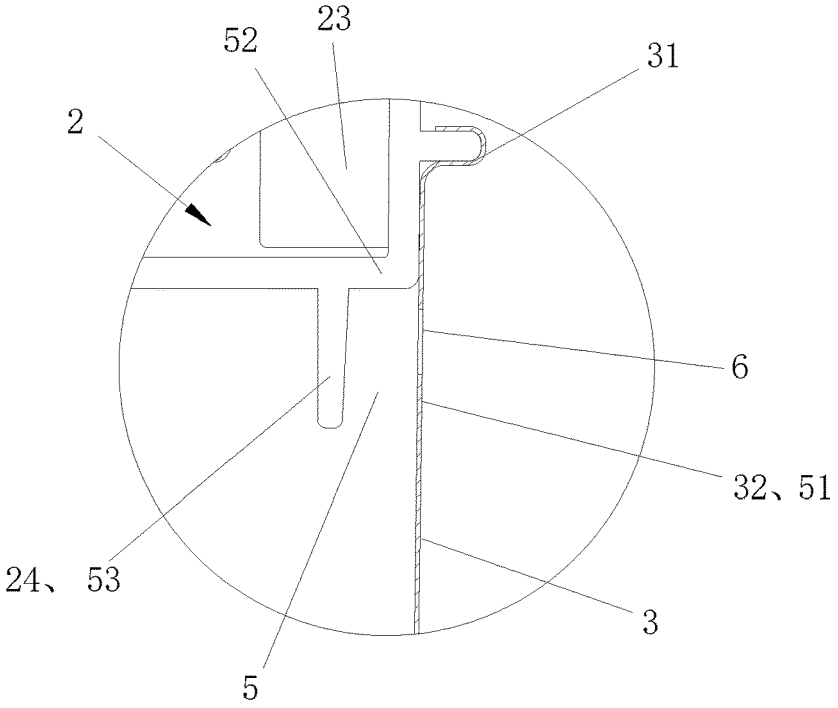

As shown in FIG. 8 to FIG. 10, in the present embodiment, a lower part of the balance ring 2 bends inwardly and a radial distance is formed between the lower part of the balance ring 2 and the forming portion 32 of the upper end of the tub body 3, the balance ring and the tub body cooperate with each other to form the annular block groove 5. The forming portion 32 extends upwardly and is fixedly connected to the upper end of the balance ring 2 to form the connecting portion 31. The lower part of the balance ring 2 which bends inwardly forms the inner side wall 53 of the annular block groove 5. The convex on the upper part of the balance ring 2 relative to the lower part of the balance ring constitutes the top wall 52 of the annular block groove 5, and the forming portion 32 constitutes the outer side wall 51 of the annular block groove 5 (see FIG. 9 and FIG. 10).

Embodiment 4

As shown in FIG. 4 and FIG. 9, the outer side wall 21 of the balance ring is provided outwardly with a circle of convex rib 22, the connecting portion 31 on the upper end of the tub body 3 is provided with a flanging 311. The flanging 311 wraps the convex rib 22 and is in a pressing connection with the convex rib. The present disclosure is not limited to this type of connection, and it is also possible to use a prior structure such as an edge connection or a screw connection. Preferably, the outer side wall 21 of the balance ring is in tightly contact with the connecting portion 31 on the upper end of the tub body 3, which are in a sealed connection. So there is no leakage between the outer side wall 21 of the balance ring and the connecting portion 31 when the inner tub rotates at a high speed.

Embodiment 5

As shown in FIG. 4, FIG. 7 and FIG. 10, the balance ring 2 comprises a main body 23 and a circle of blocking rib 24 which protrudes from a lower surface of the main body 23. There is a radial distance between the blocking rib 24 and the forming portion 32 on the upper end of the tub body 3, and the blocking rib and the forming portion 32 the tub body cooperate to form the annular block groove 5. The whole or part of the lower part of the blocking rib 24 constitutes the inner side wall 53 of the annular block groove 5. Preferably, the blocking rib 24 is inclined inwardly from top to bottom, which is convenient for the balance ring to connect to the tub body. In particular, when the opening of the upper end of the tub body is deformed, the blocking ribs is able to insert into the opening of the tub body by deformation under a certain force. The outer side wall of the main body 23 is provided outwardly with a circle of convex rib 22, the connecting portion 31 on the upper end of the tub body flanges and wraps the convex rib 22 and is in pressing connection with the balance ring 2.

Embodiment 6

Figure 11:
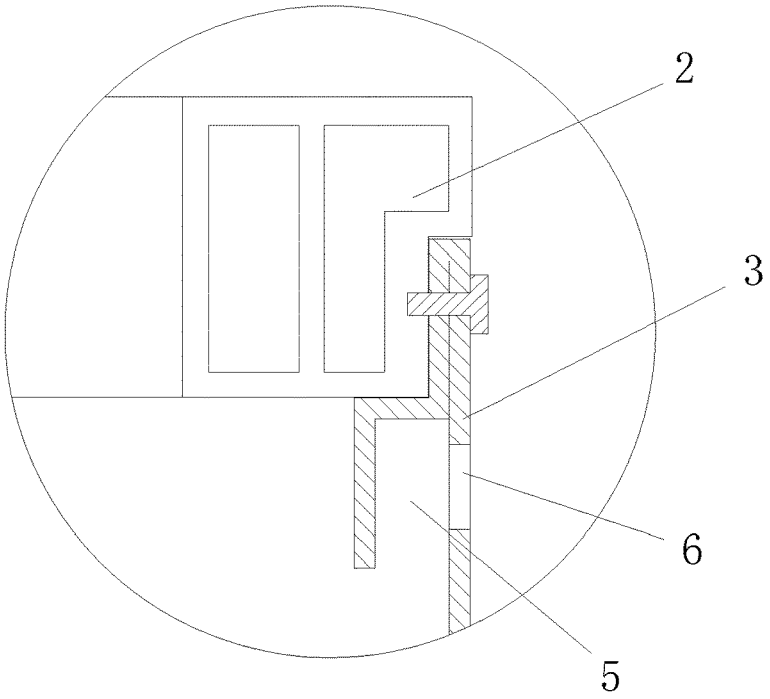
FIG. 11 is a partial magnification schematic view of the annular block groove formed by the tub body of the present disclosure.

As shown in FIG. 11, the structure of the annular block groove is different from the structure in the embodiment above. In the present embodiment, the annular block groove 5 is integrally formed by bending inwardly from an edge of the tub body 3. The balance ring 2 is mounted on the top of the annular block groove 5 and is fixedly connected through screws. Or, the balance ring is located at the inner circle of the annular block groove, the outside of the balance ring is provided with a fastening member (not shown) attached to the annular block groove.

Embodiment 7

Figure 12:
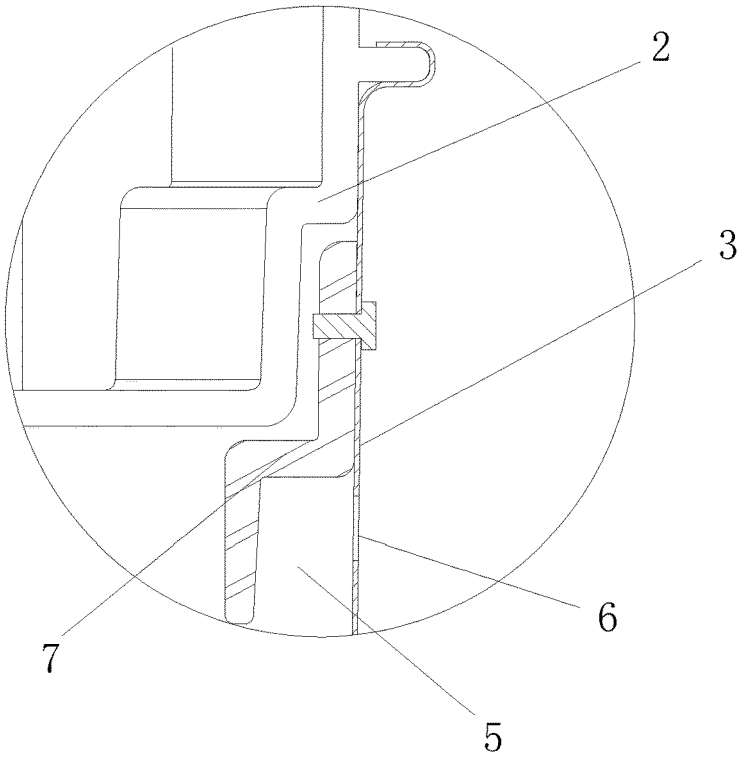
FIG. 12 a partial magnification schematic view of the annular block groove formed by the annular bending piece mounted on the tub body of the present disclosure.

Or, as shown in FIG. 12, an annular bending piece 7 is mounted on the upper end of the tub body 3, the annular bending piece 7 and the tub body 3 cooperate each other to constitute the annular block groove 5. The annular block groove 5 is under the balance ring 2. Or the annular bending piece itself constitutes the annular block groove, the annular block groove is located at the outer circle of the balance ring (not shown).

Embodiment 8

As shown in FIG. 6 and FIG. 7, the drain hole 6 is distributed in the outer side wall 51 of the annular block groove 5. Preferably, the drain hole is distributed in the outer side wall 51 and near the top wall 52 of the annular block groove, and/or the drain hole 6 is distributed in the top wall 52 of the annular block groove. Preferably, the drain hole is distributed in the top wall 52 and near the outer side wall 51 of the annular block groove.

The drain hole 6 provided in the top wall 52 of the annular block groove drains upwardly and the drained water falls down to the bottom of the outer tub through the space between the inner and outer tubs after the water is blocked by a cover of the outer tub. The drain hole 6 provided on the outer side wall 51 of the annular block groove drains in a horizontal direction, the drained falls down to the bottom of the outer tub through the gap between the inner and outer tubs after the water is blocked by the inner wall of the outer tub.

The radial distance between the blocking rib provided at the lower part of the main body of the balance ring and the forming portion of the tub body is 5 mm to 20 mm.

The relationship between a diameter of the drain hole and the spacing of the adjacent drain holes is satisfied the ratio from 1:1 to 1:10. The diameter of the drain hole is 3-8 mm, the spacing of the adjacent drain holes is 5-50 mm.

The embodiments described above may be further combined or replaced, and the embodiments are merely illustrative of the preferred embodiments of the disclosure and are not intended to limit the scope and scope of the disclosure without departing from the inventive concept of the disclosure. It will be understood by those skilled in the art that various changes and modifications in the technical solutions of the present disclosure are within the scope of the present disclosure.

The invention claimed is:

1. An inner tub of a washing machine, comprising a balance ring, a tub body and a tub bottom, and the inner tub being a water containing tub during washing, wherein:

an annular block groove which opens downward is arranged inside an upper end of the tub body, the annular block groove configured so that water circulates in the annular block groove in a circumferential direction, and the annular block groove is provided with a plurality of drain holes for draining water out of the inner tub;

wherein the balance ring is mounted on the upper end of the tub body and cooperates with the tub body to form the annular block groove;

the upper end of the tub body includes an annular connecting portion for connecting the balance ring and an annular forming portion for cooperating with the balance ring and forming a part of a side wall of the annular block groove, an outer side wall of the annular block groove coincides with the forming portion;

the forming portion on the upper end of the tub body bends inwardly and extends upwardly to form the connecting portion, the connecting portion is fixedly connected with the balance ring, an inner surface of the upper end of the tub below the lowermost portion of the balancing ring forming portion is a smooth surface.

2. The inner tub of the washing machine according to claim 1, wherein, there is a radial distance between the forming portion and an outer side wall of the balance ring, the forming portion and the balance ring cooperate with each other to form the annular block groove, the forming portion constitutes the outer side wall and a top wall of the annular block groove, and part of the outer side wall of the balance ring constitutes an inner side wall of the annular block groove.

3. The inner tub of the washing machine according to claim 2, wherein, the balance ring comprises a main body and a circle of blocking rib which protrudes from a lower surface of the main body, there is a radial distance between the blocking rib and the forming portion on the upper end of the tub body, and the blocking rib and the forming portion cooperate to form the annular block groove, an outer side wall of the main body is provided outwardly with a circle of convex rib, the connecting portion on the upper end of the tub body flanges and wraps the convex rib and is in a pressing connection with the balance ring.

4. The inner tub of the washing machine according to claim 1, wherein, a lower part of the balance ring bends inwardly, and a radial distance is formed between the lower part of the balance ring and the forming portion of the upper end of the tub body, the balance ring and the tub body cooperate with each other to form the annular block groove, the connecting portion on the upper end of the tub body is fixedly connected to the upper part of the balance ring, the lower part of the balance ring which bends inwardly forms an inner side wall of the annular block groove, convex portion of the upper part of the balance ring relative to the lower part of the balance ring constitutes a top wall of the annular block groove, and the forming portion constitutes the outer side wall of the annular block groove.

5. The inner tub of the washing machine according to claim 4, wherein, the balance ring comprises a main body and a circle of blocking rib which protrudes from a lower surface of the main body, there is a radial distance between the blocking rib and the forming portion on the upper end of the tub body, and the blocking rib and the forming portion cooperate to form the annular block groove, an outer side wall of the main body is provided outwardly with a circle of convex rib, the connecting portion on the upper end of the tub body flanges and wraps the convex rib and is in a pressing connection with the balance ring.

6. The inner tub of the washing machine according to claim 1, wherein, the outer side wall of the balance ring is provided outwardly with a circle of convex rib, the connecting portion on the upper end of the tub body is provided with a flanging, the flanging wraps the convex rib and is in a pressing connection with the convex rib.

7. The inner tub of the washing machine according to claim 1, wherein, the annular block groove is integrally formed by bending inwardly from an edge of the tub body.

8. The inner tub of the washing machine according to claim 1, wherein, an annular bending piece is mounted on the upper end of the tub body, the annular bending piece and the tub body cooperate to constitute the annular block groove, or the annular bending piece itself constitutes the annular block groove.

9. The inner tub of the washing machine according to claim 1, wherein, the drain holes are distributed in the outer side wall of the annular block groove.

10. The inner tub of the washing machine according to claim 9, wherein, the drain holes are distributed in the outer side wall and near the top wall of the annular block groove, and/or the drain holes are distributed in the top wall of the annular block groove.

11. The inner tub of the washing machine according to claim 9, wherein, the drain holes are distributed in the top wall and near the outer side wall of the annular block groove.

* * * * *